US008632163B2

(12) United States Patent
Ohsumi et al.

(10) Patent No.: US 8,632,163 B2
(45) Date of Patent: Jan. 21, 2014

(54) LIQUID EJECTING HEAD AND METHOD FOR MANUFACTURING THE SAME

(75) Inventors: Masaki Ohsumi, Yokosuka (JP); Yoshinori Tagawa, Yokohama (JP); Kazuhiro Asai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/537,204

(22) Filed: Jun. 29, 2012

(65) Prior Publication Data

US 2013/0027468 A1 Jan. 31, 2013

(30) Foreign Application Priority Data

Jul. 25, 2011 (JP) ..... 2011-161928

(51) Int. Cl.
*B41J 2/14* (2006.01)

(52) U.S. Cl.
USPC ..... 347/47

(58) Field of Classification Search
USPC ..... 347/40, 43, 47
See application file for complete search history.

(56) References Cited

U.S. PATENT DOCUMENTS

| | | | | |
|---|---|---|---|---|
| 5,738,911 | A | 4/1998 | Imamura et al. | |
| 7,300,596 | B2 | 11/2007 | Murayama et al. | |
| 7,901,064 | B2 | 3/2011 | Urayama et al. | |
| 8,042,908 | B2 * | 10/2011 | Clark et al. | 347/45 |
| 8,047,632 | B2 | 11/2011 | Fujii et al. | |
| 8,152,276 | B2 | 4/2012 | Murayama et al. | |
| 8,191,260 | B2 | 6/2012 | Kato et al. | |
| 8,191,993 | B2 * | 6/2012 | Inoue | 347/47 |
| 2009/0065472 | A1 | 3/2009 | Asai et al. | |
| 2009/0133256 | A1 | 5/2009 | Okano et al. | |
| 2012/0013682 | A1 | 1/2012 | Chida et al. | |

FOREIGN PATENT DOCUMENTS

JP 9-239992 A 9/1997

* cited by examiner

*Primary Examiner* — Lamson Nguyen
(74) *Attorney, Agent, or Firm* — Fitzpatrick, Cella, Harper & Scinto

(57) ABSTRACT

A liquid ejecting head includes a liquid ejecting port for ejecting a liquid and a nozzle layer having a liquid channel communicating with the liquid ejecting port. The nozzle layer has two layers: a first layer at the side of the liquid channel having a resin film formed with an acid and a second layer. The first layer has a smaller static contact angle of water as compared with that of the second layer.

4 Claims, 3 Drawing Sheets

LIQUID EJECTING HEAD AND METHOD FOR MANUFACTURING THE SAME

BACKGROUND OF THE INVENTION

1. Field of the Invention

The present invention relates to a liquid ejecting head to be mounted in an inkjet printer or the like and a method for manufacturing the same.

2. Description of the Related Art

Injection of liquids (e.g., ink) in the course of producing a liquid ejecting head and discharging of entrained bubbles after ejection of droplets are important factors for facilitating the production of the head and stabilizing the ejection of droplets. As a method for favorably performing these factors, Japanese Patent Application Laid-Open No. H09-239992 describes a method for hydrophilizing a channel portion of an inkjet nozzle.

Recently, since the number of ejections of ink droplets per time is increased due to improvement in printing throughput of an inkjet printer, the temperature of an inkjet recording head has tended to be raised in use. Japanese Patent Application Laid-Open No. H09-239992 describes an inkjet recording head having a hydrophilized layer including a fired layer of perhydropolysilazane on an inner wall surface of a channel, wherein the hydrophilized layer is formed of an inorganic material and other wall portions of the channel are formed of an organic material. The linear expansion coefficient of the inorganic material may be different from that of the organic material by 4 times or more, and there has been a case that the temperature of the head is raised in use and the hydrophilized layer peels off. Hence, there has been a demand for forming the hydrophilized layer from a resin which is an organic material, namely, for hydrophilizing the inner wall surface of a channel with a resin.

As a method for hydrophilizing the inner wall surface of a channel with a resin, for example, a method is considered in which a nozzle layer having an ejecting port and a liquid channel is formed in a two-layer configuration and a first layer of the two layers at the side of the channel is formed into a hydrophilized layer. As a method for manufacturing an inkjet recording head having such a configuration, a method is considered in which materials for a first layer and a second layer are applied with being stacked on a mold material which is produced by patterning and with which a portion to be subsequently formed into a channel is to be filled, to thereby form the layers. In the manufacturing method, the wall surface of the ejecting port is formed in a laminated structure of the second layer and the first layer.

The hydrophilized layer in the wall of liquid channel is required to be thin and to have no variation between nozzles. In the case that the hydrophilized layer is an inorganic film, the material for each layer can be uniformly formed into a film (film-formed) on the mold material (even if there are irregularities on the mold material) by a CVD process or the like. However, in the case that the hydrophilized layer is an organic film such as a film of a resin material, the above method cannot be adopted, and the material is commonly applied by using rotation, thereby making it very difficult to control the thickness of the hydrophilized layer (first layer) in the wall of the liquid channel and coatability on the end portion of the mold material in some cases. For example, if the hydrophilized layer is made thinner, the mold material may be deteriorated for the coatability of the end portion and the inner wall surface of the channel may not be hydrophilized. On the other hand, if the film thickness is increased in order to enhance the coatability of the hydrophilized layer on the end portion of the mold material, the film thickness of the hydrophilized layer in the wall of liquid channel may be uneven in a nozzle array, thereby causing variation in ejecting characteristics among nozzles in some cases.

Accordingly, an object of the present invention is to provide a liquid ejecting head where the hydrophilized layer does not peel off in use and the filling with a liquid (e.g., ink) and removal of entrained bubbles are easy. Another object of the present invention is to provide a method for manufacturing a liquid ejecting head which has no variation in ejecting characteristics among nozzles and in which a thin and uniform hydrophilized layer can be formed.

SUMMARY OF THE INVENTION

The present invention provides a liquid ejecting head including a liquid ejecting port for ejecting a liquid and a nozzle layer having a liquid channel communicating with the liquid ejecting port, wherein the nozzle layer has two layers, the two layers being a first layer and a second layer, and the first layer is a layer at the side of the liquid channel and has a resin film formed with an acid and further has a smaller static contact angle of water than the second layer, which is the other layer.

The present invention also provides a method for manufacturing the liquid ejecting head, including forming a mold material which contains a photoacid generator and serves as a mold for a liquid channel, on a substrate, exposing a region, where the first layer is to be formed on a surface, of the mold material, to generate an acid, forming the first layer on the surface of the mold material where the acid is generated, forming a second layer so as to coat the first layer, forming a liquid ejecting port passing through the first layer and the second layer, and removing the mold material to form a liquid channel.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

It is to be noted that the liquid ejecting head of the present invention can be used as an ejecting head for inks, chemical liquids, adhesives, solder pastes and the like. Hereinafter, the embodiments will be described while focusing on an inkjet recording head to be mounted in an inkjet recording apparatus such as an inkjet printer, among the liquid ejecting heads.

Figure 1:
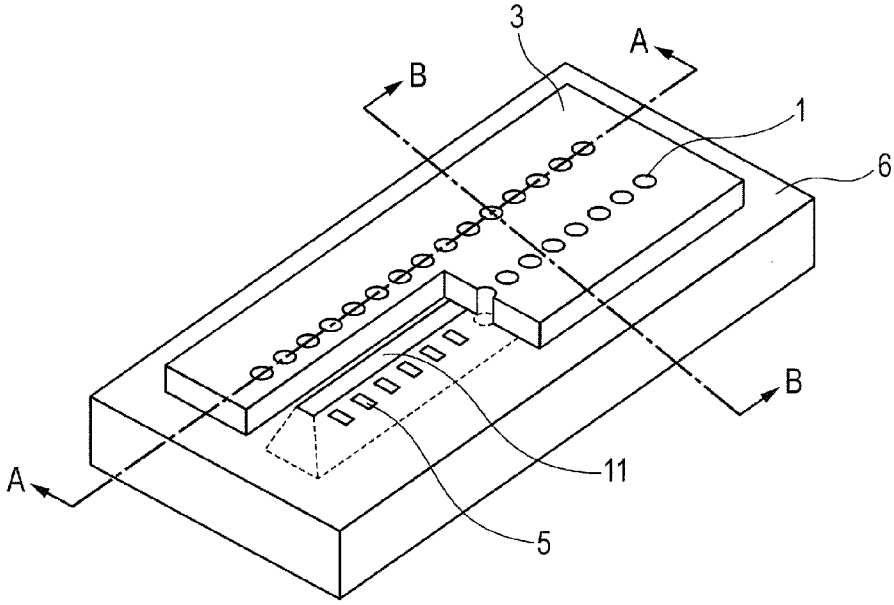
FIG. 1 is a schematic perspective view of a liquid ejecting head of the present invention.
Figure 2:
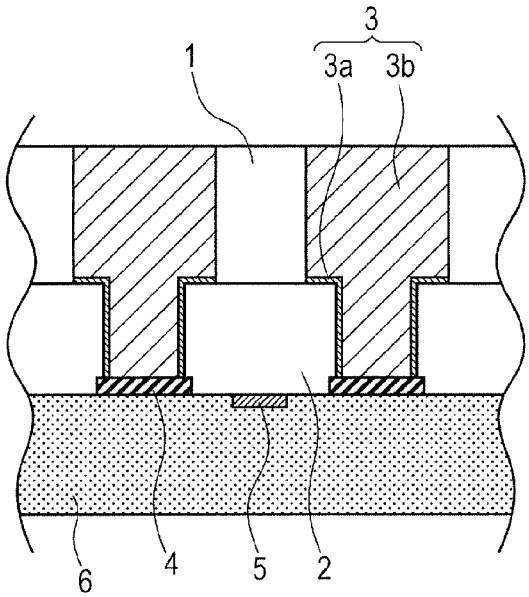
FIG. 2 is a schematic cross-sectional view of the liquid ejecting head of the present invention, taken along the line A-A of FIG. 1.

First, FIG. 1 illustrates a schematic perspective view of one example of an inkjet recording head. This inkjet recording head has a nozzle layer 3, a silicon substrate 6, and a nozzle adhesion-improving layer (reference number 4 in FIG. 2) provided between the substrate 6 and the nozzle layer 3. FIG. 2 is a schematic cross-sectional view of the inkjet recording head, cut along A-A line of FIG. 1.

The silicon substrate 6 illustrated in FIG. 1 has ink ejecting energy generating elements 5 which are liquid ejecting energy generating elements for generating energy for ejecting a liquid (specifically, ink), and a common ink supply port 11 which is a liquid supply port communicating with a liquid channel described later. In the substrate 6, the ink ejecting energy generating elements 5 are formed to be arranged in two rows (FIG. 1 only illustrates one row) at a predetermined pitch, and the supply port 11 is open between the two rows of the ink ejecting energy generating elements 5.

The nozzle layer 3 formed on the silicon substrate 6 has ink ejecting ports (liquid ejecting ports) 1 for ejecting an ink and an individual ink channel (liquid channel: reference number 2 in FIG. 2) communicating with the common ink supply port 11 and each of the ink ejecting ports 1. As illustrated in FIG. 2, each of the ink ejecting ports 1 is opened above each of the ink ejecting energy generating elements 5 (upward as viewed in the drawing), and the adhesion-improving layer 4 is formed between the substrate 6 and the wall of the liquid channel of the nozzle layer 3. The nozzle layer 3 has two layers, more specifically, has a first layer 3*a* which is a layer at the side of the liquid channel among the two layers, and a second layer 3*b* which is the other layer. As illustrated in FIG. 2, the wall surface of the ink channel 2 can be formed from the first layer 3*a* and the nozzle adhesion-improving layer 4, and the wall surface of the ejecting port 1 can be formed from a laminated structure of the first layer 3*a* and the second layer 3*b*.

In FIG. 2, the first layer 3*a* can be thinly and uniformly formed along with the wall surface of the ink channel 2 as a coating layer of coating the wall surface of the ink channel 2 and the second layer 3*b* is formed on areas of the nozzle layer (the wall of the ink channel and the wall of the ejecting port) other than this first layer. For the nozzle layer 3 within the wall (between the walls of the liquid channels) between two ink channels which are adjacent to each other, the second layer is formed between thin and uniform two first layers in the direction parallel to the substrate 6 (in the horizontal direction as viewed in FIG. 2).

It is to be noted that in the present invention, the first layer 3*a* may be placed closer the ink channel 2 than the second layer 3*b*. For example, as shown in FIG. 2, the first layer may be formed as the coating layer on the wall surface of the ink channel, or alternatively, the ink channel wall portion in the nozzle layer may be formed only of the first layer.

The first layer has as the base material a resin film formed with an acid. The first layer may preferably have a resin having a hydroxy group (first layer-forming material) as a hydrophilizing agent. The first layer can also be formed by curing a mixture of a resin film-formed with an acid and a resin having a hydroxy group.

Examples of the resin film-formed with an acid may include an epoxy resin and a phenol resin, and these resins may be used singly or in a combination of two or more resins. It is to be noted that the film formed with an acid means that a polymerization reaction is caused to occur by an acid to produce a polymeric material (cured product).

Examples of the resin having a hydroxy group may include polyhydroxystyrene, novolac, and polyvinylalcohol, and these materials may be used singly or in a combination of two or more materials.

The content of the above resin film formed with an acid in the first layer-forming material may be 80% by mass or more from the viewpoint of film stability (film peeling resistance).

The content of the above resin having a hydroxy group in the first layer-forming material may be 20% by mass or less from the viewpoint of film stability.

The first layer-forming material can further contain a curing agent in addition to these resins in order to enhance the film stability. A solution obtained by dissolving the first layer-forming material in a solvent can be used to form the first layer.

One resin may be used as both the resin film formed with an acid and the resin having a hydroxy group, and such a resin may include, for example, novolac.

In the case that the first layer-forming material contains, for example, the resin having a hydroxy group, the material can form as the first layer a hydrophilized layer having a static contact angle of water of 30° or less. For example, if the second layer is formed from a photosensitive resin, the static contact angle of water is usually about 60° and thus the static contact angle of water to the first layer 3*a* is smaller than the angle to the second layer 3*b*. In the present invention, the static contact angle of water to the first layer may be smaller than the angle to the second layer, and the static contact angle of water to each layer can be appropriately adjusted depending on properties of an ink to be used (e.g., water-solubility or oiliness). The static contact angle of water to each layer can be measured with a contact angle meter. The second layer may be a cured product of a photosensitive resin, and as the photosensitive resin, any photosensitive resin known in the art of the liquid ejecting head can be used, and further, a variety of additives such as photopolymerization initiator can also be blended thereto. As the photosensitive resin, for example, an epoxy resin to which a photopolymerization initiator blended can be used.

The nozzle layer 3 having the above configuration, in which the hydrophilic first layer is formed, can make the inner wall surface of the individual ink channel 2 hydrophilic. Thus, hydrophilization of the nozzle material can be achieved by adding the resin having a hydroxy group to the resin film formed with an acid, which is the base material of the nozzle layer. Herein, such hydrophilization means that the static contact angle with water is made 30° or less.

The inkjet recording head is placed so that the surface of the nozzle layer 3, where the ejecting ports 1 are formed, is faced toward a recording surface of a recording medium. Then, by applying pressure from the ink ejecting energy generating elements 5 to an ink (liquid) filled in the ink channel 2 via the common ink supply port 11, ink droplets are ejected from the ink ejecting ports 1 and caused to adhere to a recording medium, thereby enabling the recording operation.

The inkjet recording head is produced by a manufacturing method of the present invention described later, thereby enabling the production of the nozzle layer in which the periphery of the mold material, namely, the inner wall surface of the liquid channel is selectively hydrophilized and also enabling the formation of the nozzle layer having a thin and uniform thickness of the hydrophilized layer within the wall of the ejecting port and within the wall of the liquid channel. The inkjet recording head produced by the manufacturing method of the present invention has no variation in ejecting characteristics among the nozzles and a channel which is high in hydrophilicity, thereby making filling with an ink and removal of entrained bubbles easy.

Next, the manufacturing method of the present invention will be described in detail with reference to FIGS. 3A to 3J.

Herein, FIGS. 3A to 3J are a schematic cross-sectional views of an inkjet recording head in each step, taken along B-B line of FIG. 1.

Figure 3A:
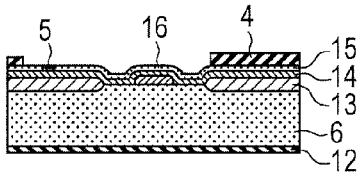
FIGS. 3A, 3B, 3C, 3D, 3E, 3F, 3G, 3H, 3I and 3J are schematic cross-sectional views for explaining each step in a manufacturing method of the present invention.

First, as illustrated in FIG. 3A, a nozzle adhesion-improving layer 4 is formed on a silicon substrate provided with ink ejecting energy generating elements 5 (adhesion layer-forming step). The crystal orientation of a silicon substrate 6 is (100) face. The drawing shows such a case that the substrate having a crystal orientation of (100) face is used, but it does not limit the face orientation.

The nozzle adhesion-improving layer 4 may be directly formed on the surface of the silicon substrate 6, or other layers may be present between the nozzle adhesion-improving layer 4 and the substrate 6. In FIG. 3A, a thermally oxidized film 13 is present on the substrate 6, a silicon oxide film 14 which is an insulating layer is present on the thermally oxidized film (upward as viewed in the drawing), and a plurality of the ink ejecting energy generating elements 5 (one element in FIGS. 3A to 3J), such as heat resistors, are placed upward as viewed in the drawing. A silicon nitride film 15 as a protective film is present thereon. Reference number 16 represents a sacrificial layer in forming a supply port passing through the substrate. A thermally oxidized film 12 is further formed on the back surface of substrate 6 (which is opposite to the surface on which the nozzle layer of the substrate is formed, that is, the front surface).

The nozzle adhesion-improving layer 4 can be formed using a polyetheramide resin or polyamide. The nozzle adhesion-improving layer 4 is provided to thereby enable the enhancement of adhesion properties of the nozzle layer 3 (e.g., second layer 3*b*) to the surface of the substrate (when the above-mentioned other layers are present, it refers to the surface of the layers). In FIG. 3A, the nozzle adhesion-improving layer 4 adhered to the silicon nitride film 15 is illustrated. The adhesion-improving layer 4 can be formed by applying a material for forming the layer 4 (e.g., polyetheramide resin) on the substrate 6 by, for example, a spin coating method to form a layer of the material, and appropriately removing an unnecessary portion of the layer, namely, a layer portion other than the adhesion-improving layer 4 by patterning and etching.

Figure 3B:
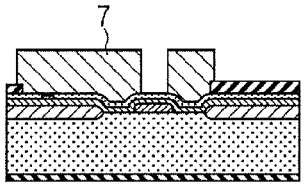

Next, as illustrated in FIG. 3B, a mold material 7 which contains a photoacid generator and serves as a mold for an ink channel 2 is formed on the substrate 6 on which the ink ejecting energy generating elements 5 are formed (mold material-forming step). The mold material may be directly formed on the surface of the silicon substrate 6, or other layers (e.g., adhesion-improving layer 4 and silicon nitride film 15) may be present between the mold material 7 and the substrate 6. In the manufacturing method of the present invention, since the mold material 7 is removed to thereby form the ink channel, a material obtained by adding a photoacid generator to a resin soluble in a solvent can be used as a material for the mold material 7.

As the photoacid generator, for example, a photoacid generator which generates an acid upon i-ray (wavelength: 365 nm) exposure can be used. The mold material 7, namely, an ink channel pattern can be formed by applying the material for the mold material on the substrate by, for example, a spin coating method, and then exposing and developing the material using, for example, Deep UV light (wavelength: 240 to 300 nm). More specifically, the mold material 7 can be formed by applying on the substrate, for example, a positive type photosensitive material to which the photoacid generator is added, exposing a portion of the applied material other than the mold material 7 to the Deep UV light to increase the solubility of the material to a developer, and removing the exposed portion.

Herein, it is desirable that the mold material 7 be formed of a material which is not formed into a film (film-formed) with an acid generated from the photoacid generator. It is further desirable that the mold material 7 can be patterned by a method (e.g., exposure by using the above Deep UV light and development) other than the reaction mediated by the photoacid generator, namely, the polymerization reaction by the acid generated from the photoacid generator. As a material of forming such a mold material 7, for example, a material obtained by adding the photoacid generator to ODUR (trade name, produced by Tokyo Ohka Kogyo Co., Ltd.) can be used.

On the other hand, a hydrophilized nozzle material layer 10 described later can be formed by film formation with the acid derived from the mold material, generated from the photoacid generator, and can be patterned utilizing the polymerization reaction with the acid to form a first layer 3*a*.

Figure 3C:
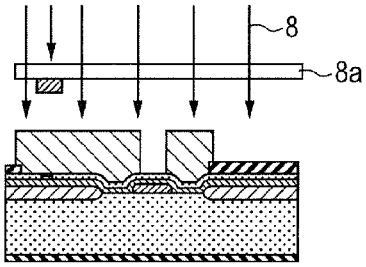

Next, as in illustrated in FIG. 3C, a region (area) for producing the first layer on the surface, of the mold material 7, is exposed to generate the acid (acid-generating step).

The above region is exposed to generate the acid on the region, and thereafter the material for the first layer is applied to the region and baked, thereby enabling the formation of the first layer having a desired thickness on a predetermined position, specifically, on the surface of the mold material of the portion where the acid is generated. In FIG. 3C, a region on which the first layer is to be formed on the surface, of the mold material, specifically, a region other than the portion on which the ejecting port is to be subsequently formed is irradiated (exposed) with light 8 using a mask 8*a*. Consequently, the hydrophilized layer (first layer) is not formed on the surface of the mold material of the portion which is not irradiated with the light 8 (light shielding portion).

For generating the acid, the exposure wavelength, the amount of the exposure, the baking temperature and the baking time can be appropriately selected depending on the photoacid generator used and the thickness of the first layer formed.

Figure 3D:
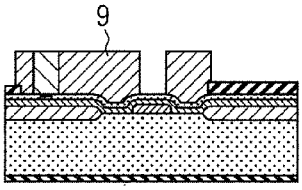
Figure 5A:
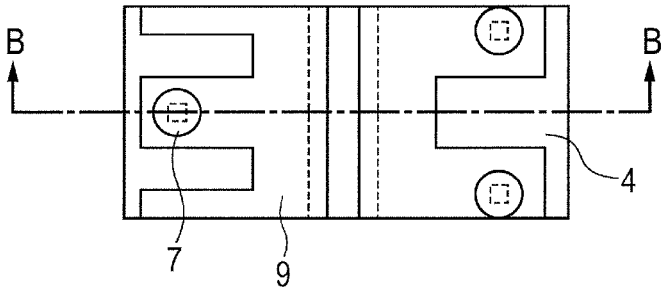
FIGS. 5A and 5B are two views of FIG. 3D, a top view and a cross-sectional view.
Figure 5B:
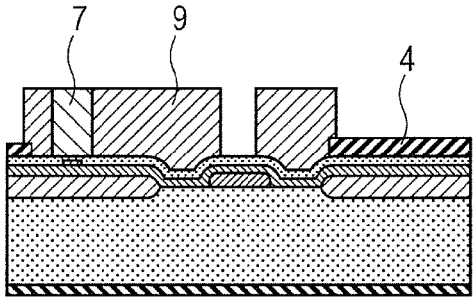

The state after exposure is illustrated in FIG. 3D and FIGS. 5A and 5B. FIGS. 5A and 5B illustrate a relationship between the top view and cross-sectional view of FIG. 3D. As illustrated in these views, the area on which the ejecting port is to be formed is not irradiated with light and generates no acid, thereby still remaining as the mold material 7. On the other hand, the acid is generated in the portion indicated by reference numeral 9, and the first layer can be formed on the surface of the portion. Although the areas other than the mold material have been irradiated with light, the acid is not present (generated) in the areas because the photoacid generator is not included in the areas. Thus, in the present invention, it is desirable that each layer and film other than the mold material contain no photoacid generator.

Figure 3E:
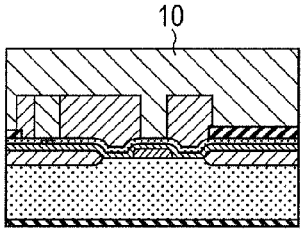
Figure 3F:
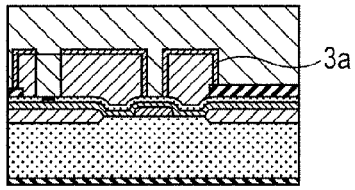
Figure 3G:
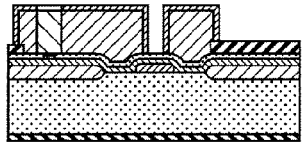

Subsequently, as illustrated in FIGS. 3E to 3G, the first layer 3*a* is formed on the mold material 9 on which the acid is generated, more specifically, on the surface of the mold material 9 (first layer-forming step). Specifically, first, as illustrated in FIG. 3E, a raw material for the first layer is applied to the areas exposed to the surface at the front surface side of the substrate 6 (in FIG. 3E, the surfaces of the mold materials and 9, adhesion-improving layer 4 and silicon nitride film 15) by, for example, a spin coating method, thereby forming the hydrophilized nozzle material layer 10.

The hydrophilized nozzle material layer 10 (the raw material for the first layer) has a resin which is formed into a film (film-formed) with the acid. The layer 10 may preferably have a resin having a hydroxy group. As the resin which is film-formed with the acid, for example, at least one of an epoxy resin and a phenol resin can be used.

As the resin having a hydroxy group, for example, at least one of polyhydroxystyrene, novolac and polyvinylalcohol can be used.

The first layer 3*a* is a cured product of the hydrophilized nozzle material layer, which first layer can be specifically a product obtained by curing the hydrophilized nozzle material layer with the acid from the photoacid generator and baking.

Thereafter, the substrate on which the layer 10 is formed is baked, thereby diffusing the acid from the surface of the mold material 9 to the inside of the hydrophilized nozzle material layer 10 to form the hydrophilic first layer 3*a* on the position where the layer 10 is in contact with the mold material 9, as illustrated in FIG. 3F. In this way, the hydrophilized nozzle material layer (raw material for the first layer) can be baked to cause the material to react with the acid coming from the photoacid generator in the mold material and thus cured.

Thereafter, as illustrated in FIG. 3G, an unnecessary portion of hydrophilized nozzle material layer 10, namely, the hydrophilized nozzle material layer portion other than the first layer is removed by developing with a developer. Thus, the first layer 3*a* can be selectively formed only on a desired area on the surface of the mold material 9.

The thickness of the first layer 3*a* from the surface of the mold material may preferably be 1 μm or less from the viewpoint of stabilizing the shape of the ejecting port in the vicinity of the ink channel.

Figure 4:
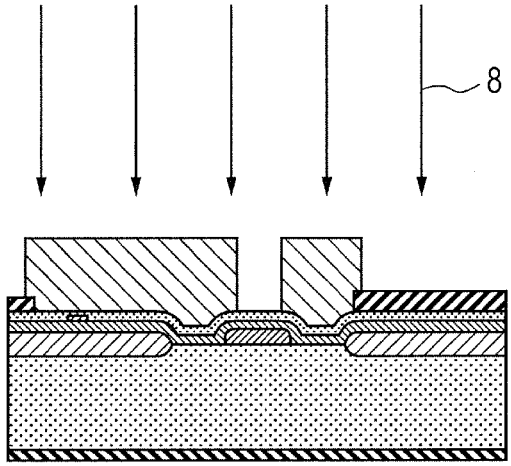
FIG. 4 is a schematic cross-sectional view for explaining the case where the whole surface is exposed in FIG. 3C.

While the region other than the portion on which the ejecting port is to be formed, of the mold material is selectively exposed to light in FIG. 3C, the whole surface at the front surface side of the substrate can also be exposed to form the first layer on the whole surface of the mold material 7 as illustrated in FIG. 4. In this case, the first layer portion (the first layer portion to be formed into the ejecting port 1) in contact with the ejecting port may preferably be removed simultaneously when the mold material 9 in the channel is removed, to thereby form the ink channel 2 and the ejecting port 1. For example, in the case that the first layer is formed in a thickness of 0.2 μm by exposing the mold material 7 in an amount of 2,000 J and baking at a temperature of 80° C. for 2 minutes, the mold material 9 in the channel and the first layer portion in contact with the ejecting port can be easily removed simultaneously.

Figure 3H:
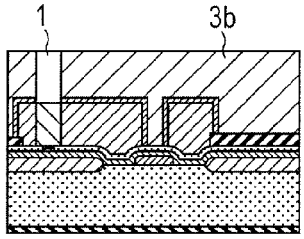

Subsequently, as illustrated in FIG. 3H, a photosensitive resin which is a material for the second layer 3*b* is applied to the respective surfaces of the first layer and the nozzle adhesion-improving layer (in fact, mold material 7, first layer 3*a*, nozzle adhesion-improving layer 4 and silicon nitride film 15) to form a photosensitive resin layer. Thereafter, the photosensitive resin layer is exposed and developed via a mask (not illustrated) to form the second layer 3*b* having the ejecting port 1 (second layer- and ejecting port-forming step). The ejecting port penetrates through the first layer 3*a* and the second layer 3*b* in the vertical direction of the drawing.

Figure 3I:
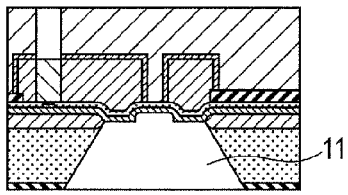

Then, as illustrated in FIG. 3I, the sacrificial layer 16 is removed by, for example, anisotropic etching to form an ink supply port 11 on the substrate 6 (ink supply port-forming step). Specifically, the thermally oxidized film 12 on the back surface of the substrate 6 is patterned to make bare a silicon surface serving as an initiation surface for anisotropic etching, and then silicon anisotropic etching is performed. The ink supply port 11 is formed by chemical etching of the substrate 6, for example, anisotropic etching with a strong alkaline solution such as TMAH (tetramethylammonium hydroxide) or KOH (potassium hydroxide).

Figure 3J:
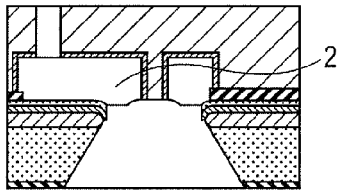

Then, as illustrated in FIG. 3J, the mold material is removed to form the ink channel 2 (mold material-removing step). Specifically, the silicon oxide film 14 is removed by wet etching using, for example, a hydrofluoric acid solution. Thereafter, the silicon nitride film 15 is removed by dry etching or the like. Then, the mold materials 7 and 9 are eluted with a solvent from the ink ejecting port 1 and the ink supply port 11, thereby forming the ink channel 2 (e.g., bubbling chamber). When the mold material (the mold material and the first layer in the case that the whole surface is exposed, as in FIG. 4) is removed, simultaneous use of ultrasonic immersion as required enables the material to be easily removed. Herein, the mold material is exposed to a light at a wavelength depending on the mold material (e.g., Deep UV light) before being removed and thus can be solubilized, and can be removed with the above solvent.

Subsequently, the substrate 6 obtained through the foregoing steps, on which substrate the nozzle portion (ejecting port, ink channel and ink supply port) is formed can be divided and cut with a dicing saw or the like, and chipped. Furthermore, the obtained chips are electrically joined in order to drive the ink ejecting energy generating elements 5, and then an inkjet recording head to which a chip tank member for supplying an ink is connected can be formed.

While the nozzle layer is formed of two layers in the above steps, the nozzle layer may be formed only of the above first layer. Namely, in the stage of FIG. 3G, the first layer 3*a* may also be allowed to serve as the nozzle layer to form the ejecting port in the first layer 3*a*.

EXAMPLES

Hereinafter, examples of the inkjet recording head among the liquid ejecting heads of the present invention will be shown.

Example 1

As illustrated in FIG. 3A, a silicon substrate 6 having a crystal orientation of (100) face was used. The silicon substrate 6 had a thermally oxidized film 13, a silicon oxide film 14, ink ejecting energy generating elements 5, a silicon nitride film 15 and a sacrificial layer 16 on the front surface, and had a thermally oxidized film 12 on the back surface.

On the surface of the silicon substrate 6, namely, on the surface of the silicon nitride film, a nozzle adhesion-improving layer 4 including a polyetheramide resin (trade name: HIMAL-1200 produced by Hitachi Chemical Co., Ltd.) was formed. Specifically, the above polyetheramide resin was applied to the surface of the substrate 6 by a spin coating method to form a resin layer, and an unnecessary portion, namely, the resin layer portion other than the adhesion-improving layer 4 was removed by patterning and etching to be the adhesion-improving layer 4. Herein, the thickness of the adhesion-improving layer 4 was made 2 μm.

Then, as illustrated in FIG. 3B, a soluble resin (resin obtained by adding a photoacid generator to ODUR (trade name, produced by Tokyo Ohka Kogyo Co., Ltd.)) was applied to the substrate 6 by a spin coating method, and thereafter, the resin was exposed to Deep UV light and developed to form an ink channel pattern (mold material 7). As the photoacid generator, a photoacid generator which generates an acid upon exposure to i-ray was used.

Then, as illustrated in FIGS. 3C and 3D, a region on which the first layer was to be formed on the surface, of the mold material, namely, a region other than a portion on which the ejecting port was to be formed was exposed to light 8 having a wavelength of 365 nm in an exposure amount of 3,000 J to generate an acid from the photoacid generator on the exposed mold material portion. Herein, since a portion other than the mold material did not contain the photoacid generator, the acid was not generated on such a portion.

Thereafter, as illustrated in FIG. 3E, a solution was prepared by adding 100 parts by mass of polyvinylalcohol as a resin having a hydroxy group to 900 parts by mass of an epoxy resin (trade name: EHPE3150, produced by Daicel Corporation) as a resin film-formed by the acid and dissolving the resultant in a solvent (diglyme). Then, the solution was applied to the front surface side of the substrate 6 by spin coating to form a hydrophilized nozzle material layer 10.

Then, baking at 90° C. was performed for 4 minutes and thus the acid was diffused from the mold material 9 to the inside of the hydrophilized nozzle material layer 10, thereby forming a hydrophilic first layer 3*a* on the mold material as illustrated in FIG. 3F. Herein, the first layer 3*a* thus formed has a thickness of about 1 μm, and the thickness of such a level enables the easy ensuring of a satisfactory adhesion force between the adhesion-improving layer and the first layer 3*a*.

Thereafter, as illustrated in FIG. 3G, unnecessary hydrophilized nozzle material layer 10 was removed by developing with a developer (MIBK (methyl isobutyl ketone)).

Then, as illustrated in FIG. 3H, a photosensitive resin (resin obtained by adding a photoinitiator to EHPE3150 (trade name, Daicel Corporation)) as a material for a second layer was applied to the front surface side of the substrate 6 to form a photosensitive resin layer. Then, the resin layer was exposed and developed to form an ejecting port 1 and a second layer 3*b*.

Herein, when measured with a contact angle meter, the static contact angle of water to the first layer 3*a* was 30° and the static contact angle of water to the second layer 3*b* was 60°. Accordingly, the static contact angle of water to the first layer was smaller than the angle to the second layer.

Thereafter, as illustrated in FIG. 3I, a thermally oxidized film 12 on the back surface of the substrate 6 was patterned to make bare a silicon surface serving as an initiation surface for anisotropic etching, and then silicon anisotropic etching was performed to form an ink supply port 11.

Subsequently, as illustrated in FIG. 3J, the silicon oxide film 14 was removed by wet etching using a hydrofluoric acid solution, and the silicon nitride film 15 was removed by dry etching. Then, the mold materials 7 and 9 were eluted using a solvent from the ink ejecting port 1 and the ink supply port 11, thereby forming an ink channel 2. Herein, the mold material had been irradiated with Deep UV light to become solubilized before it was removed.

The substrate 6 obtained through the foregoing steps was divided and cut with a dicing saw and chipped, and then the chips were electrically joined in order to drive the ink ejecting energy generating elements 5 to obtain an inkjet recording head to which a chip tank member for supplying an ink was connected.

Comparative Example 1

An inkjet recording head was produced in the same manner as in Example 1 except that the hydrophilized layer (first layer 3*a*) was not formed. Specifically, a second layer was directly formed on a mold material without adding a photoacid generator to the soluble resin and without performing the acid-generating step and the first layer-forming step illustrated in FIGS. 3C to 3G.

The inkjet recording head produced in Example 1 was compared with the inkjet recording head in Comparative Example 1, not having a hydrophilized layer, for evaluation. It was confirmed that the inkjet recording head produced in Example 1 had no variation in ejecting characteristics among the nozzles, thereby making filling with an ink and removal of entrained bubbles easy, relative to Comparative Example 1.

The present invention can provide a liquid ejecting head where a hydrophilized layer does not peel off during use and filling with a liquid (e.g., ink) and removal of entrained bubbles are easy. The present invention can further provide a method for manufacturing a liquid ejecting head that has little variation in ejecting characteristics among the nozzles and enables the formation of a thin and uniform, hydrophilized layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-161928, filed Jul. 25, 2011, which is hereby incorporated by reference herein in its entirety.

What is claimed is:

1. A liquid ejecting head comprising a liquid ejecting port for ejecting a liquid and a nozzle layer having a liquid channel communicating with the liquid ejecting port, wherein the nozzle layer has two layers, the two layers being a first layer and a second layer, and the first layer is a layer at the side of the liquid channel and has a resin film formed with an acid and further has a smaller static contact angle of water than that of the second layer.

2. The liquid ejecting head according to claim 1, wherein the resin film formed with an acid comprises at least one resin of an epoxy resin and a phenol resin.

3. The liquid ejecting head according to claim 1, wherein the first layer comprises a resin having a hydroxy group.

4. The liquid ejecting head according to claim 3, wherein the resin having a hydroxy group comprises at least one resin selected from the group consisting of polyhydroxystyrene, novolac and polyvinylalcohol.

* * * * *